US007476116B2

(12) United States Patent
Shinozaki

(10) Patent No.: US 7,476,116 B2
(45) Date of Patent: Jan. 13, 2009

(54) CONNECTOR OF THE MOVABLE MEMBER TYPE

(75) Inventor: Tetsuya Shinozaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/958,450

(22) Filed: Dec. 18, 2007

(65) Prior Publication Data

US 2008/0146067 A1 Jun. 19, 2008

(30) Foreign Application Priority Data

Dec. 19, 2006 (JP) ..... 2006-340979

(51) Int. Cl.
*H01R 4/50* (2006.01)

(52) U.S. Cl. ..... 439/345

(58) Field of Classification Search ..... 439/345, 439/157, 160, 152–153, 159, 372, 350, 352
See application file for complete search history.

(56) References Cited

U.S. PATENT DOCUMENTS

| | | | | |
|---|---|---|---|---|
| 5,427,539 | A * | 6/1995 | Saito | 439/157 |
| 5,980,283 | A | 11/1999 | Okabe | |
| 6,254,408 | B1 * | 7/2001 | Hattori et al. | 439/157 |
| 6,733,313 | B2 | 5/2004 | Shinozaki et al. | |
| 7,090,518 | B1 | 8/2006 | Osada et al. | |
| 7,396,240 | B2 * | 7/2008 | Frederiksen et al. | 439/157 |
| 2006/0096848 | A1 | 5/2006 | Sakatani et al. | |

FOREIGN PATENT DOCUMENTS

| | | |
|---|---|---|
| JP | 8-22864 | 1/1996 |

* cited by examiner

*Primary Examiner*—Edwin A. Leon
(74) *Attorney, Agent, or Firm*—Gerald E. Hespos; Anthony J. Casella

(57) ABSTRACT

With a pair of housings (10, 30) connected, a lever (20) provided in a female housing (10) is prevented from separating from a male housing (30) at two positions, i.e. at an engaged position of a cam follower (34) and a cam groove (25) and an engaged position with a preventing portion (36). These two separation preventing positions are separated in a direction normal to connecting and separating directions of the female housing (10) to prevent inclinations of the two housings (10, 30).

11 Claims, 12 Drawing Sheets

CONNECTOR OF THE MOVABLE MEMBER TYPE

BACKGROUND OF THE INVENTION

1. Field of the Invention

The invention relates to a connector of the movable member type, such as a lever-type connector, as well as to a connection method therefore.

2. Description of the Related Art

U.S. Patent Application Publication No. 2006/0096848 discloses a lever-type connector in which two housings are connected by rotating a lever. This lever-type connector is constructed such that the lever is rotatably supported in the female housing and a cam follower engageable with a cam groove of the lever is provided in the male housing. If the lever is rotated with the two housings lightly fitted to each other and the cam follower located at the entrance of the cam groove, the two housings are pulled toward each other to reach a properly connected state by cam action caused by the engagement of the cam groove and the cam follower.

The lever-type connector of this kind might have a problem if the housings are longer in a direction normal to a connecting direction of the housings. In this situation, a clearance is defined between the two housings to avoid a forcible connection. If an external force is given to the housings connected with each other, the housings will incline substantially about the cam follower due to the presence of the clearance. Such inclinations could cause the housings to separate at one end in the longitudinal direction of the housings to make contact state of terminal fittings of the housings unstable.

The invention was developed in view of the above situation and an object thereof is to prevent a pair of housings in a connected state from being inclined.

SUMMARY OF THE INVENTION

The invention relates to a connector with first and second housings that are connectable with and separable from each other. A movable member is supported on the first housing, and at least one cam follower is provided on the second housing for engaging at least one cam groove of the movable member. Movement of the movable member generates a cam action between the cam groove and the cam follower for at least assisting the connection and separation of the housings. The second housing includes at least one preventing portion spaced from the cam follower in a direction at an angle to the connecting and separating directions of the housings. The preventing portion is engageable with the movable member for locking with the housings connected, and is adapted to prevent the movable member from separating from the second housing by the engagement with the movable member.

The movable member on the first housing preferably is prevented from separating from the second housing at two positions with the housings connected, i.e. at the engaged position of the cam follower and the cam groove and at the engaged position with the preventing portion. These two separation preventing positions are separated in the direction at an angle to the connecting and separating directions of the housings to prevent inclinations of the two housings.

The movable member preferably is a lever rotatably mounted on the first housing.

The preventing portion spaced from the cam follower in a direction normal to connecting and separating directions of housings.

The first housing and the movable member preferably include partial locking means for holding the movable member at an initial position where entrance of the cam follower into the cam groove is permitted. The preventing portion preferably is arranged at a position to contact the partial locking means when a connecting operation of the housings is started and while the cam follower is inserted into the cam groove. Thus, the preventing portion preferably contacts the partial locking means and frees the movable member from a partly locked state at the initial position.

The lever is held at the initial position where the entrance of the cam follower into the cam groove is permitted for connecting the two housings. Thus, the cam follower can be inserted reliably into the cam groove when the connecting operation of the two housings is started. Further, the preventing portion is disengaged to free the lever from the locked state at the initial position when the connecting operation of the two housings is started. Thus, the lever can be operated immediately after the cam follower enters the cam groove to provide good operability.

The partial locking means preferably comprises a substantially cantilever-shaped partial locking arm.

Two preventing portions preferably are provided at substantially opposite sides of the cam follower in a direction at an angle, and preferably a substantially right angle to the connecting and separating directions of the housings.

Inclinations of the two housings can be prevented reliably since the movable member is prevented from separating from the second housing at three positions, i.e. at the pair of preventing portions and at the cam follower.

At least one latch preferably is provided for locking the movable member at a connection position where the housings are connected properly, to prevent a returning movement of the movable member towards the initial position.

The connector may further comprise guide means for guiding the relative movement of the housings with respect to each other.

These and other objects, features and advantages of the invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
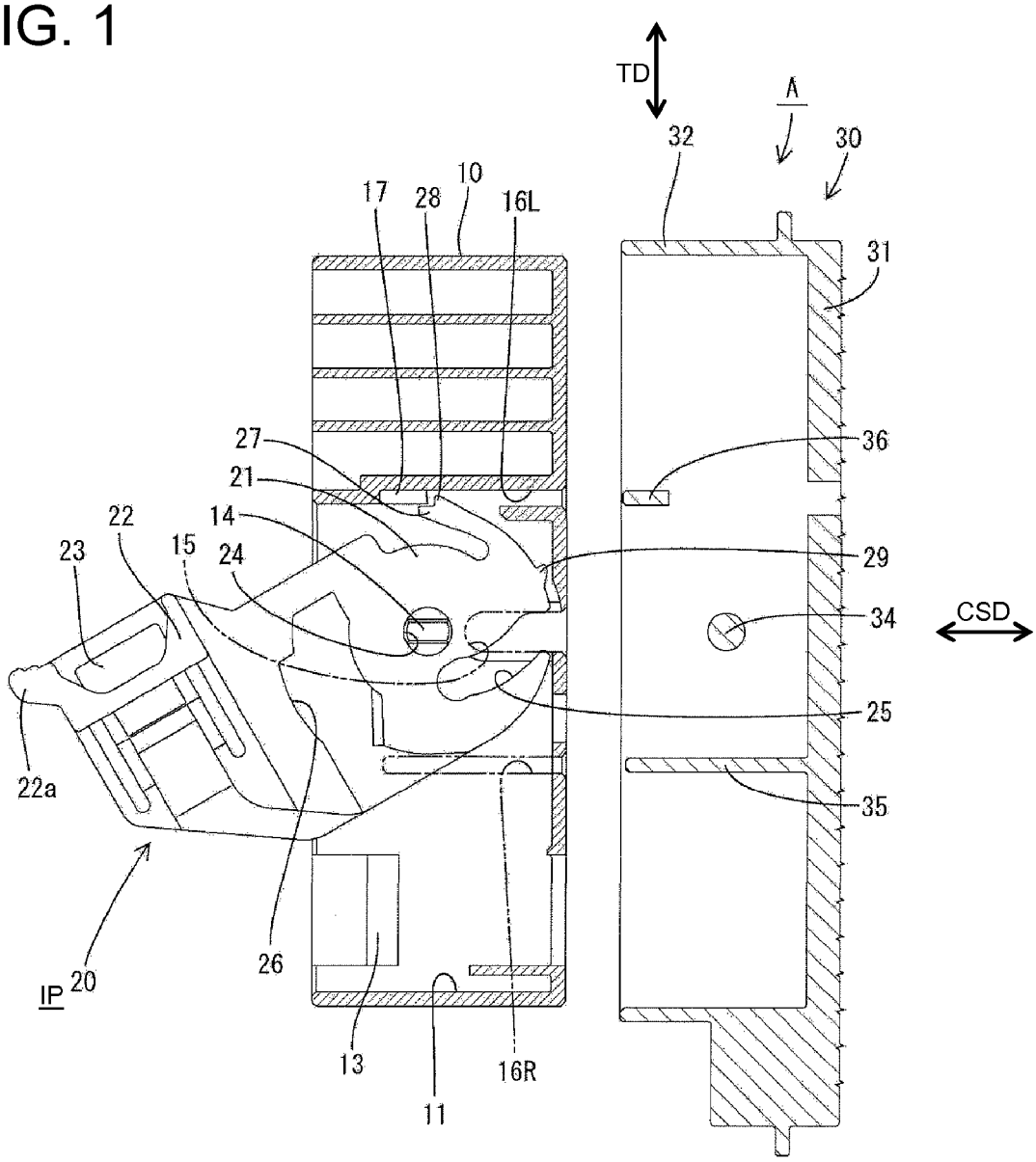
FIG. 1 is a horizontal section showing a separated state of two male and female housings according to a first embodiment.

A lever-type connector in accordance with a first embodiment of the invention includes a female housing and a male housing that are identified respectively by the numerals 10 and 30 in FIGS. 1 to 8. The connector also includes a lever 20 mounted to the female housing 10.

The female housing 10 is made e.g. of synthetic resin and is in the form of a block that is longer in the transverse direction (i.e. direction normal to the connecting and separating directions CSD of the housings 10, 30). An accommodation space 11 is formed inside the female housing 10 and defines a horizontal slit extending substantially along the upper wall of the female housing 10. The accommodation space 11 makes an opening in the rear surface of the female housing 10, and the lever 20 is accommodated in the accommodation space 11. Unillustrated female terminal fittings are accommodated in a terminal accommodating portion 12 below and adjacent to the accommodation space 11 in the female housing 10 and are arrayed in vertical and horizontal directions.

The lower wall defining the accommodation space 11 is formed with a latch 13 for locking the lever 20 at a connection position CP. The lower wall of the accommodation space 11 also has a support shaft 14 projecting with an axial line oriented vertically and substantially normal to the connecting and separating directions CSD. The latch 13 is arranged near the right end of the female housing 10 with respect to transverse direction TD, and the support shaft 14 is arranged at a substantially at a central position of the female housing 10 with respect to transverse direction TD. The upper wall of the female housing 10 is formed with a cutout 15 and left and right guide grooves 16L, 16R. The cutout 15 is arranged to correspond to the support shaft 14 in the transverse direction TD and extends straight back from the front end of the female housing 10 substantially parallel with the connecting and separating directions CSD of the two housings 10, 30. The left and right guide grooves 16L, 16R are arranged transversely symmetrically at opposite left and right sides of the cutout 15 and extend straight back from the front end of the female housing 10 substantially parallel with the connecting and separating directions CSD of the two housings 10, 30, similar to the cutout 15. The cutout 15 and the guide grooves 16L, 16R cause the inside of the accommodation space 11 to communicate with the outside of the female housing 10. Further, a partial locking piece 17 is formed at a position corresponding to the left guide groove 16L in the accommodation space 11.

The lever 20 is made e.g. of synthetic resin and includes a main portion 21 in the form of a single plate arranged substantially normal to the axis of the support shaft 14. The lever 20 has an operable portion 22 that projects from the outer peripheral edge of the main portion 21 and that has a thickness larger than the main portion 21. At least one lock arm 23 is provided on the operable portion 22 for locking the lever 20 at the connection position CP. The lock arm 23 is resiliently deformable up in a direction substantially normal to the connecting and separating directions CSD.

The main portion 21 is formed with a substantially round bearing hole 24 that engages the support shaft 14 with most of the main portion 21 in the accommodation space 11. The lever 20 is rotatable about the support shaft 14 between an initial position IP (see FIGS. 1, 2 and 4 to 6) and the connection position CP (see FIG. 3). The main portion 21 is formed with a cam groove 25 that extends through an arc from the outer peripheral edge towards the bearing hole 24. The cam groove 25 intersects a movement path of the lever 20 to become gradually closer thereto as the lever 20 is rotated to assist or perform the connection of the two housings 10, 30. The cam groove 25 vertically penetrates the main portion 21, and an opening of the cam groove 25 at the outer peripheral edge of the main portion 21 serves as an entry for permitting the entrance of a cam follower 34. Further, a recess 26 is formed in the upper surface of the main portion 21 for avoiding interference with a guide rib 35 of the male housing 30.

The main portion 21 also is formed with a partial locking arm 27 that is cantilevered to extend from the outer peripheral edge of the main portion 21. The partial locking arm 27 is resiliently deformable to move towards the outer peripheral edge of the main portion 21. The outer peripheral edge of the partial locking arm 27 has an arcuate shape substantially concentric with the bearing hole 24, and a locking projection 28 projects substantially radially out from the outer peripheral edge near the leading end of the partial locking arm 27. Further, an arcuate edge portion is formed at the outer periphery of the main portion 21 and is continuous with the outer peripheral edge of the partial locking arm 27 with substantially the same curvature. This arcuate edge portion is formed with a receiving projection 29 between the base end of the partial locking arm 27 and the entrance of the cam groove 25.

The male housing 30 is made e.g. of synthetic resin and similar to the female housing 10 is longer in the transverse direction. The male housing 30 is formed unitarily with a terminal holding wall 31 and a rectangular tubular receptacle 32 that projects forward towards the female housing 10 from the outer periphery of the terminal holding wall 31. The receptacle 32 is configured to receive the female housing 10. Substantially L-shaped male terminal fittings 33 are passed through the terminal holding wall 31, and horizontal front sections of the male terminal fittings 33 are accommodated in the receptacle 32.

The cam follower 34 projects in and down from a transverse intermediate position on the upper wall of the receptacle 32. The cam follower 34 has a substantially cylindrical shape with an axial line that extends substantially normal to the connecting and separating directions CSD of the two housings 10, 30. The guide rib 35 is formed on the inner surface of the upper wall of the receptacle 32 and extends substantially straight in forward and backward directions parallel to the connecting and separating directions CSD of the two housings 10, 30. The guide rib 35 extends continuously from the terminal holding wall 31 towards the front end of the receptacle 32 and is disposed at a side of the cam follower 34 that corresponds to the right guide groove 16R in the female housing 10. Similarly, a substantially rib-shaped preventing portion 36 is formed at the front end of the inner surface of the upper wall of the receptacle 32 close to the opening of the receptacle 32 and extends in forward and backward directions parallel to the connecting and separating directions CSD of the two housings 10, 30. The preventing portion 36 is at a side of the cam follower 34 opposite the guide rib 35 and is arranged to correspond to the left guide groove 16L in the female housing 10. There is no projection from the upper wall behind the preventing portion 36.

To connect the housings 10, 30, the lever 20 is held at the initial position IP in the female housing 10 as shown in FIG. 1. The partial locking piece 17 of the female housing 10 engages the locking projection 28 of the partial locking arm 27 of the lever 20 to define a partial locking means for holding the lever 20 at the initial position. Rotation of the lever 20 toward the connection position CP is prevented by the partial locking means. Rotation of the lever 20 towards a side opposite to the connection position CP (clockwise in FIG. 1) is prevented by unillustrated known locking means. The entrance of the cam groove 25 faces the cutout 15 with the lever 20 at the initial position IP so that the cam follower 34 can enter the cam groove 25.

Figure 2:
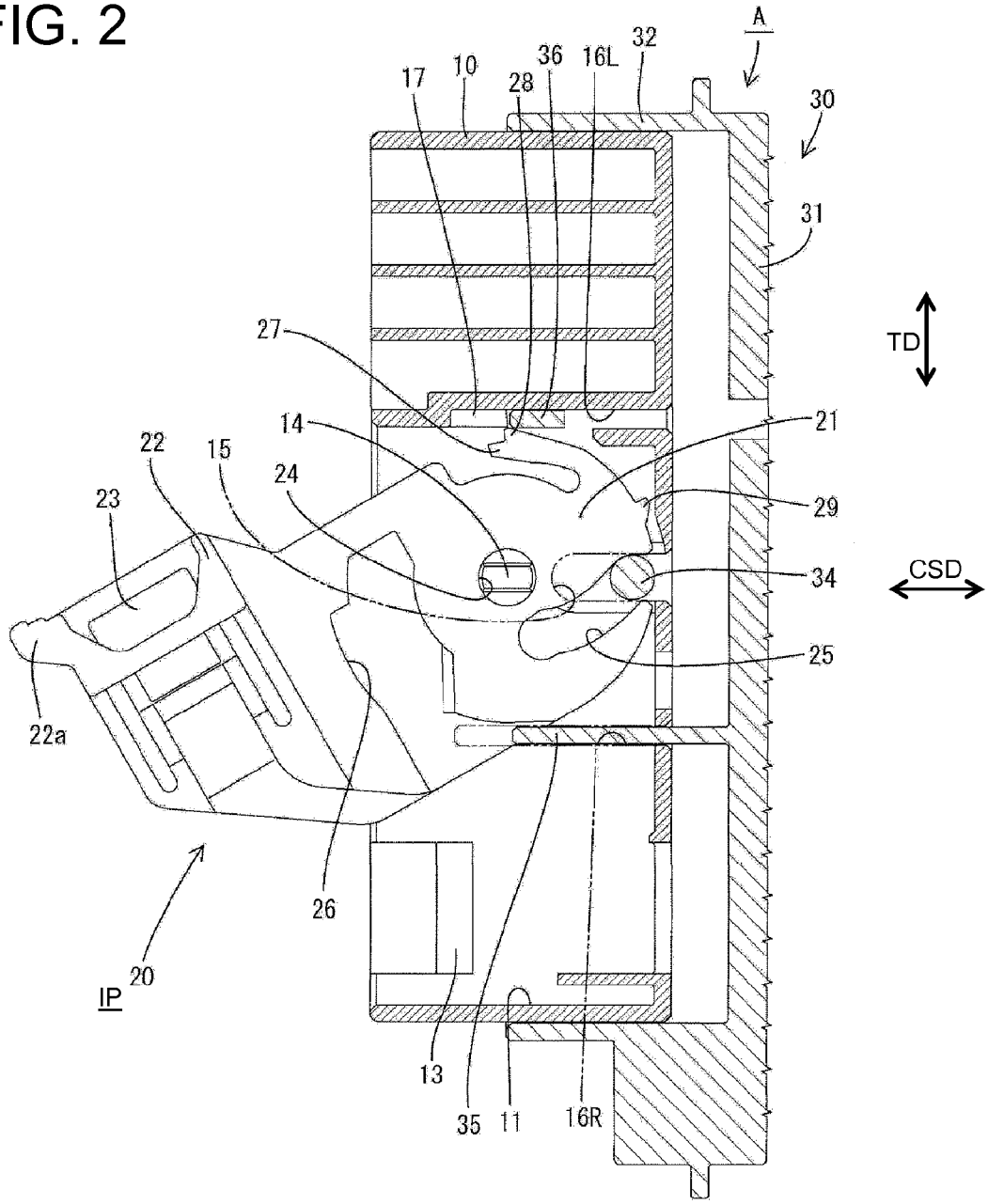
FIG. 2 is a horizontal section showing an intermediate state of a connecting operation of the two housings.
Figure 3:
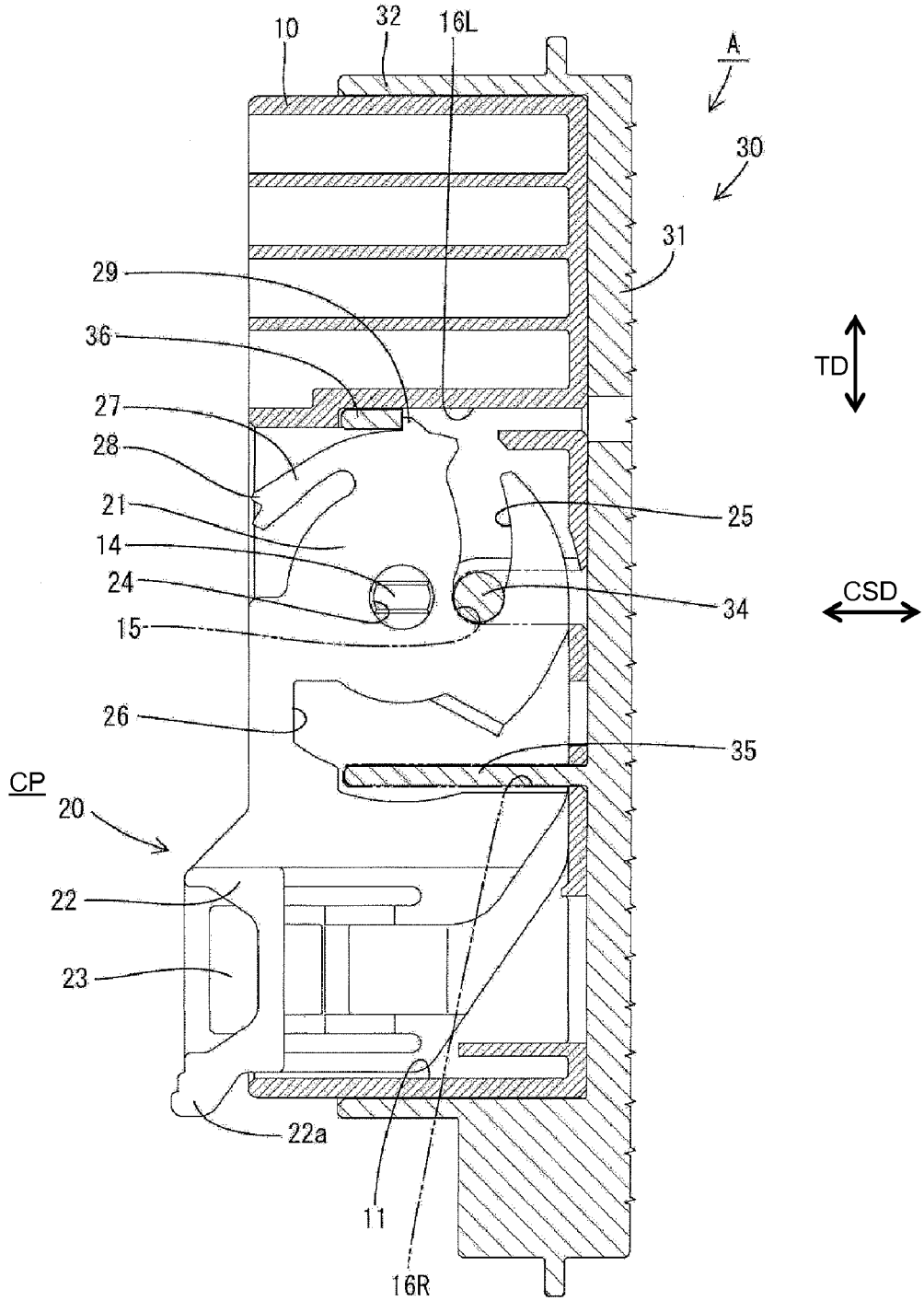
FIG. 3 is a horizontal section showing a connected state of the housings.
Figure 4:
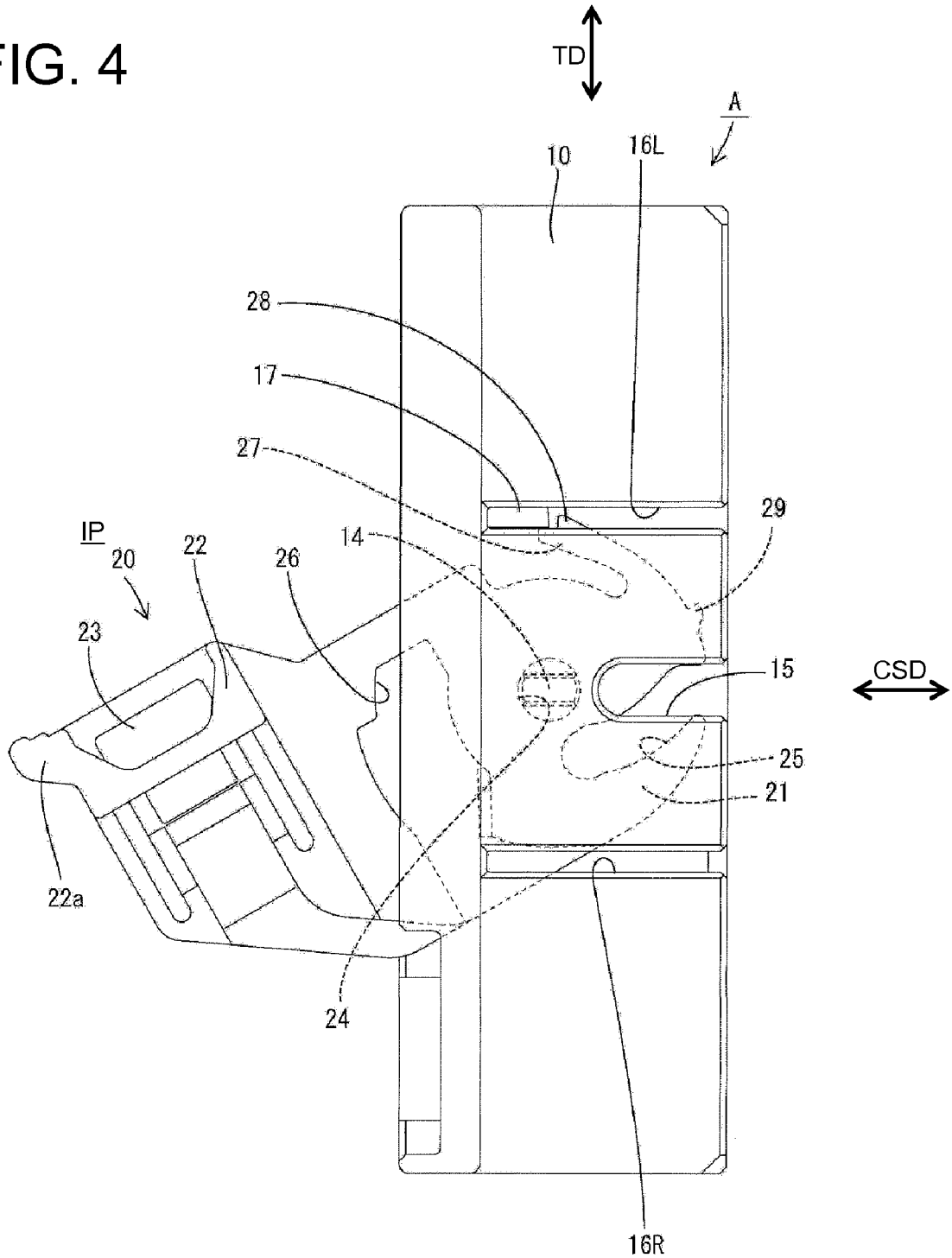
FIG. 4 is a plan view of the female housing with a lever at an initial position.
Figure 5:
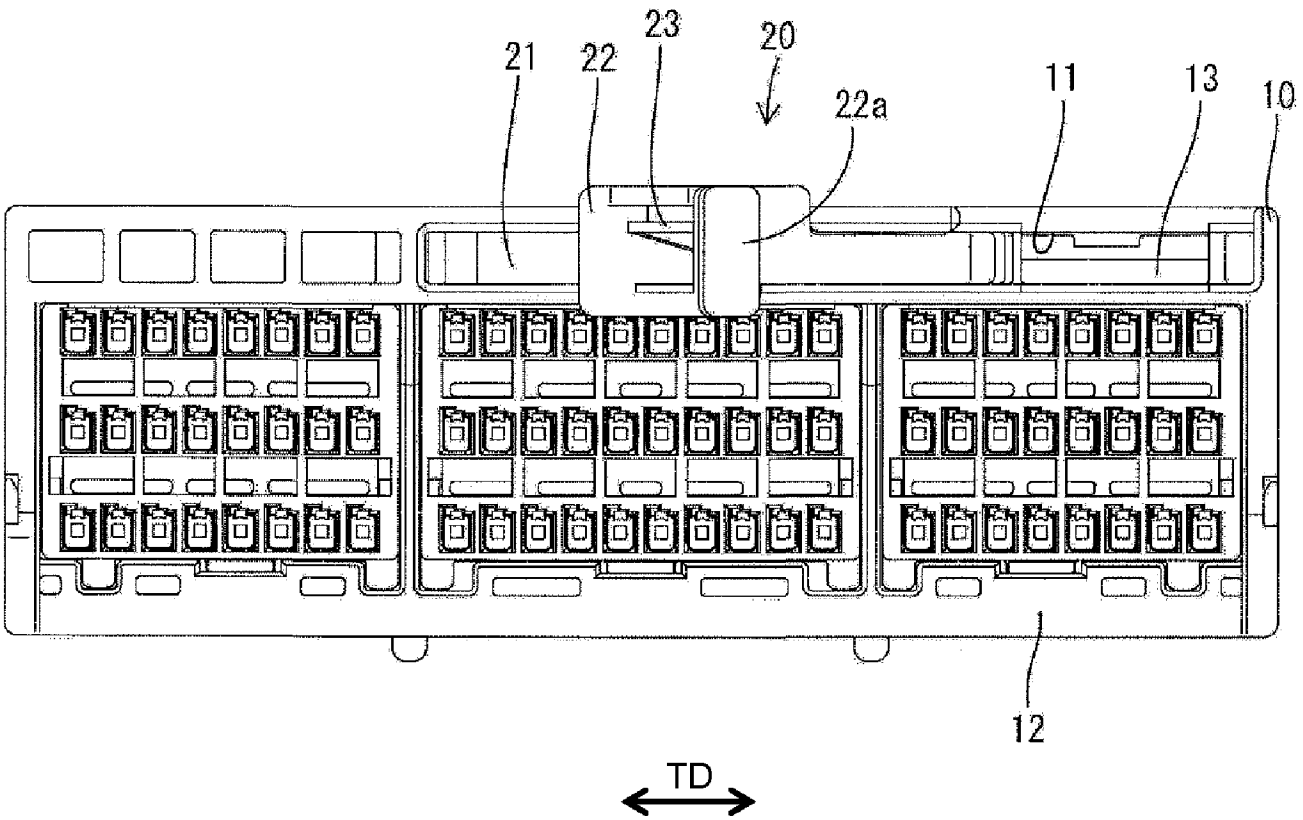
FIG. 5 is a rear view of the female housing with the lever at the initial position.
Figure 6:
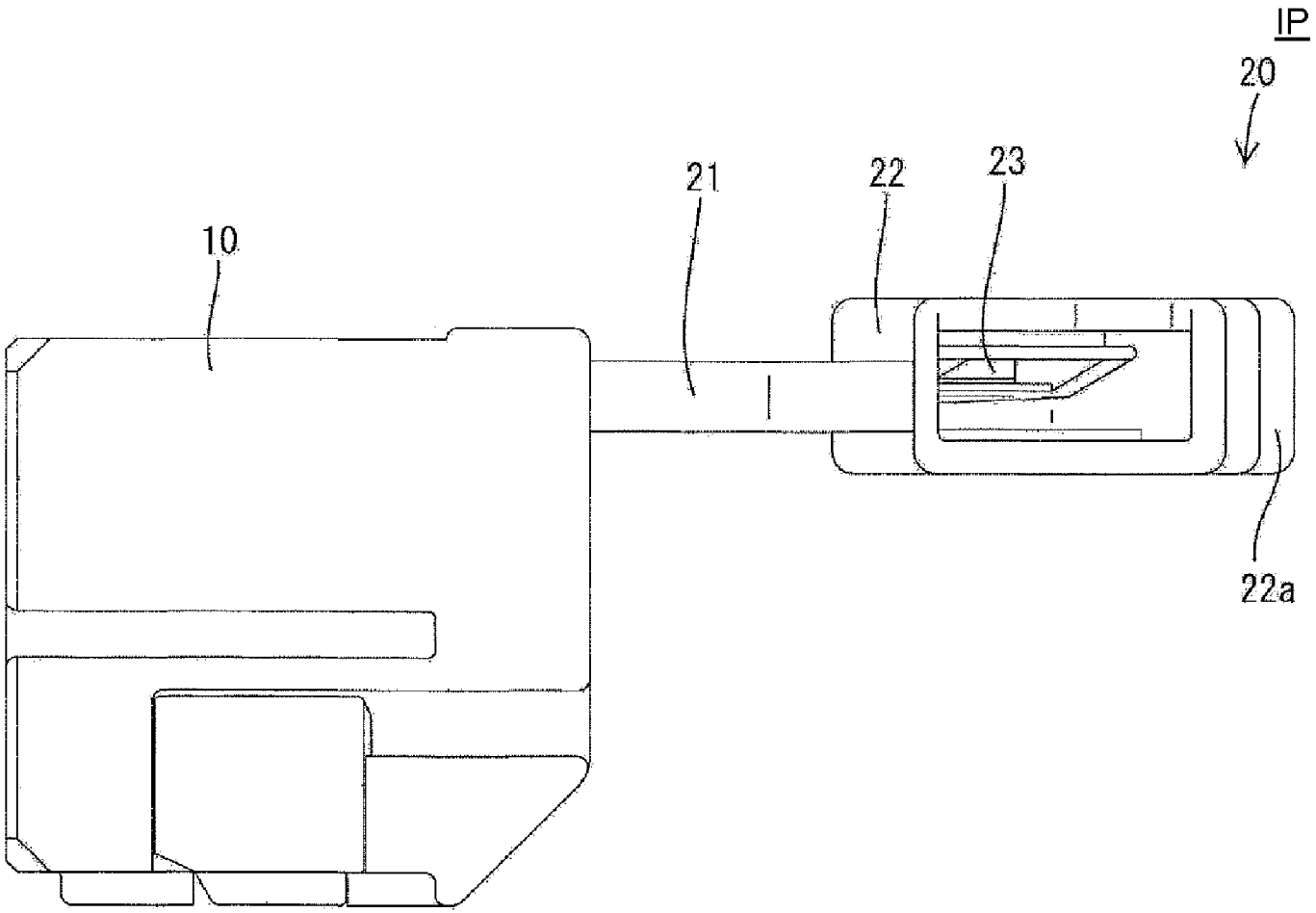
FIG. 6 is a side view of the female housing with the lever at the initial position.
Figure 7:
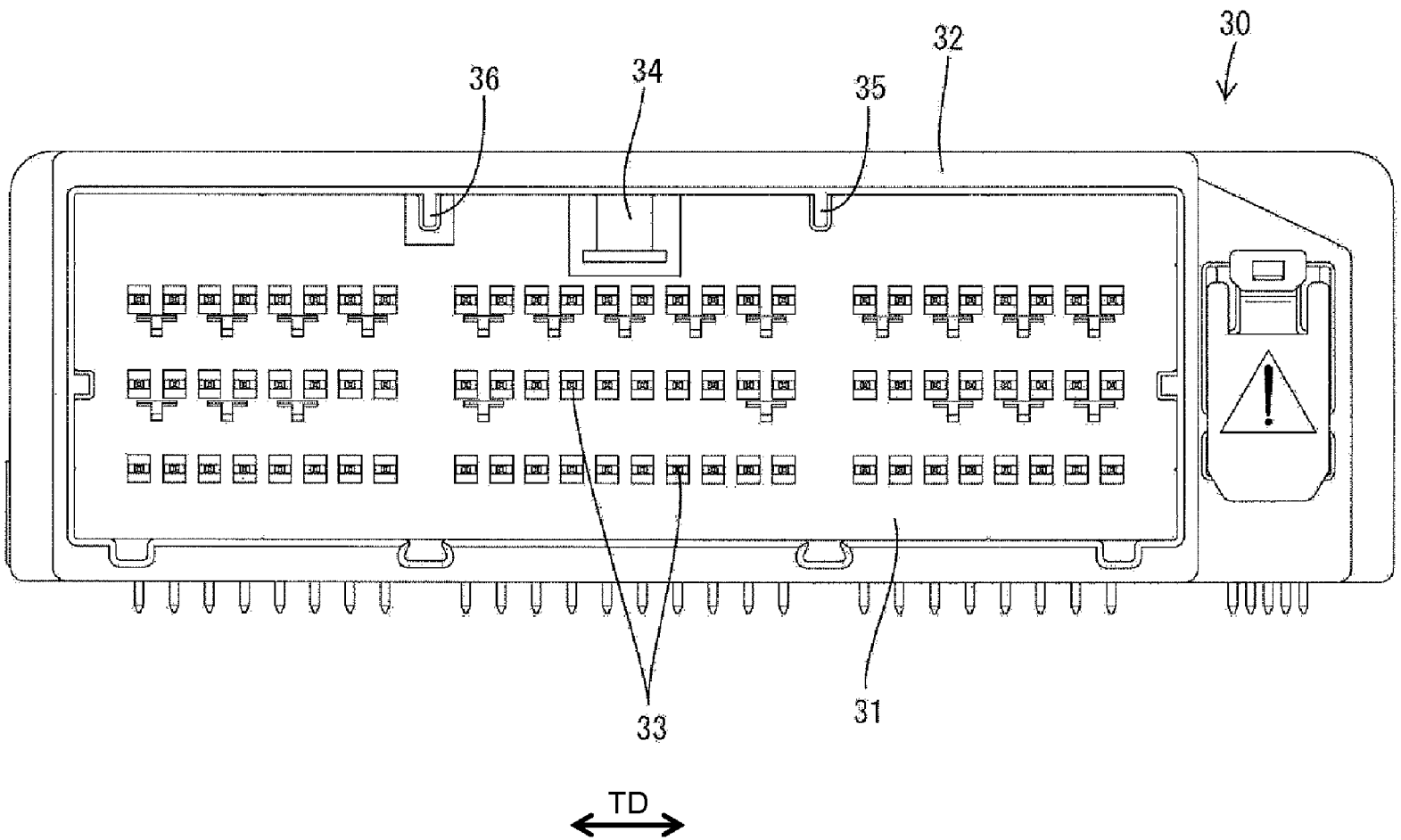
FIG. 7 is a front view of the male housing.
Figure 8:
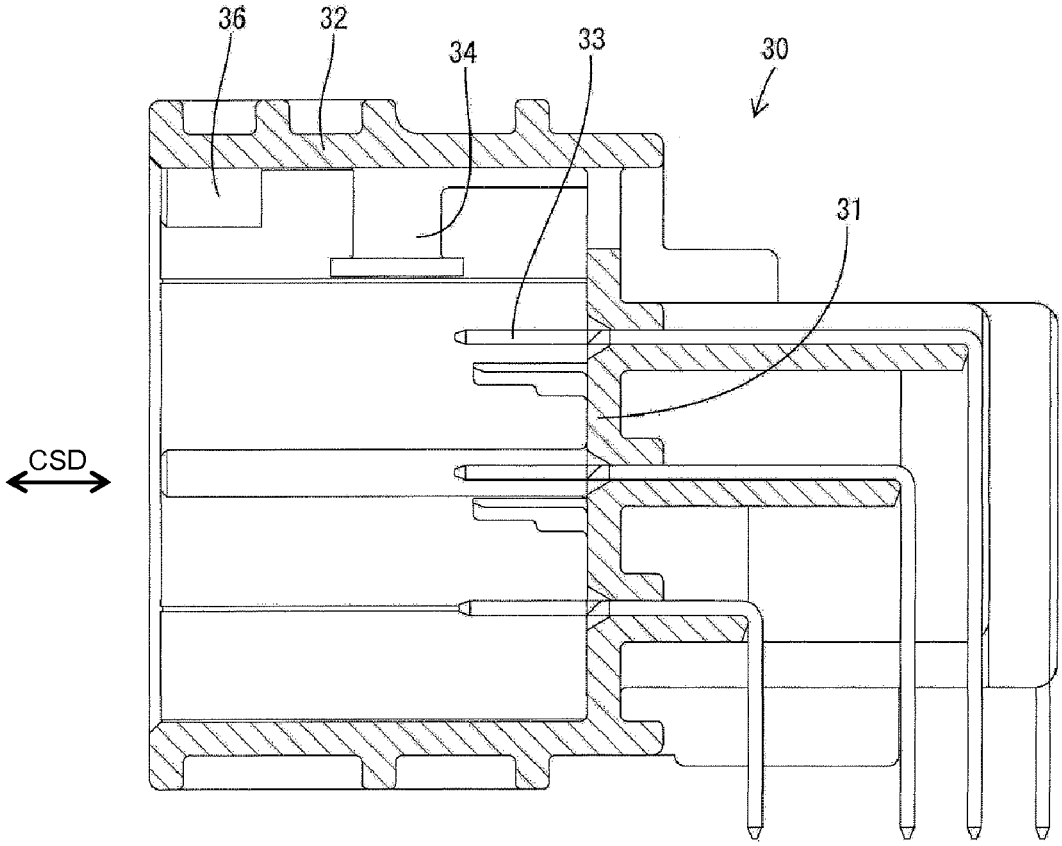
FIG. 8 is a vertical section of the male housing.
Figure 9:
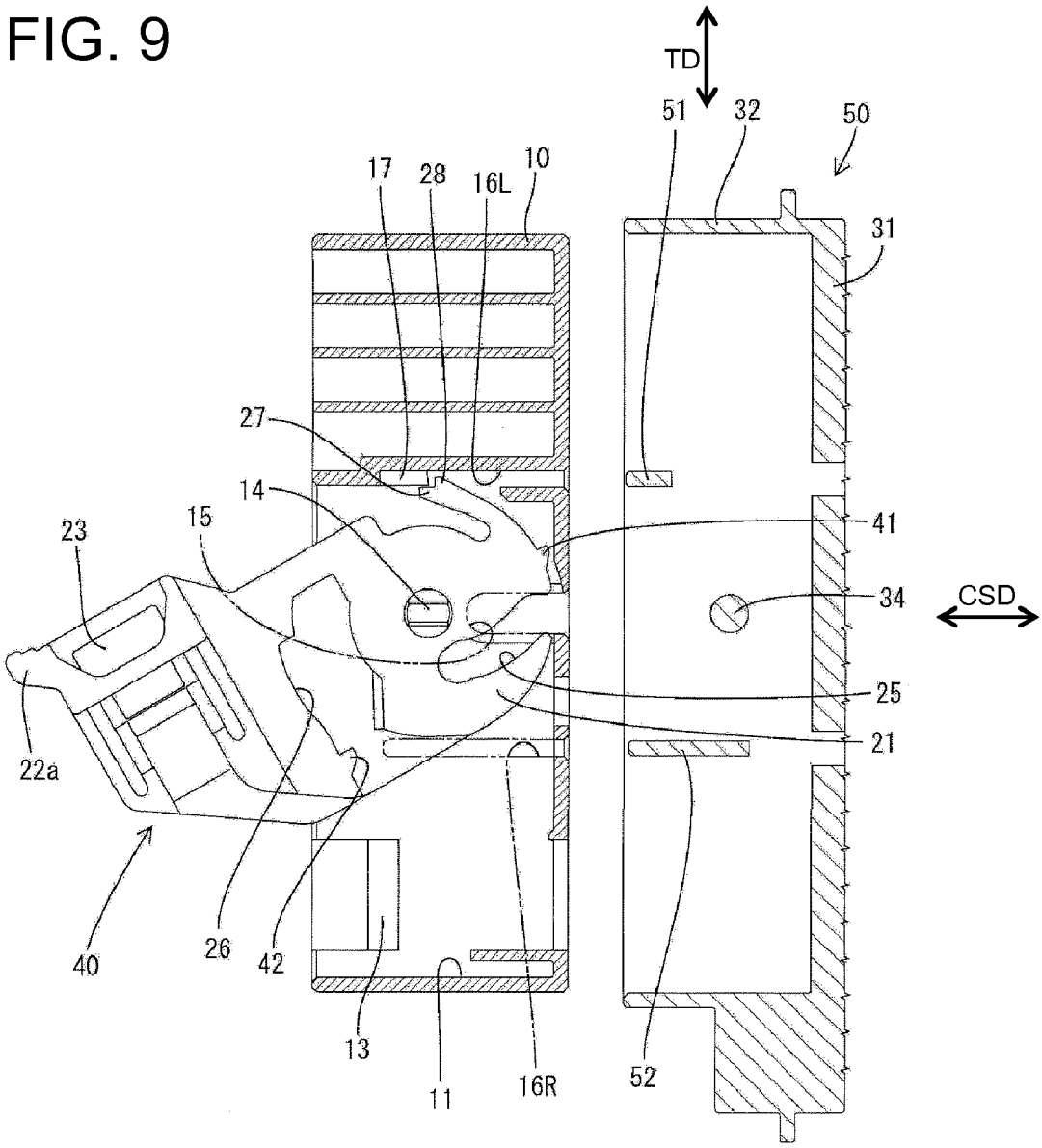
FIG. 9 is a horizontal section showing a separated state of two male and female housings according to a second embodiment.
Figure 10:
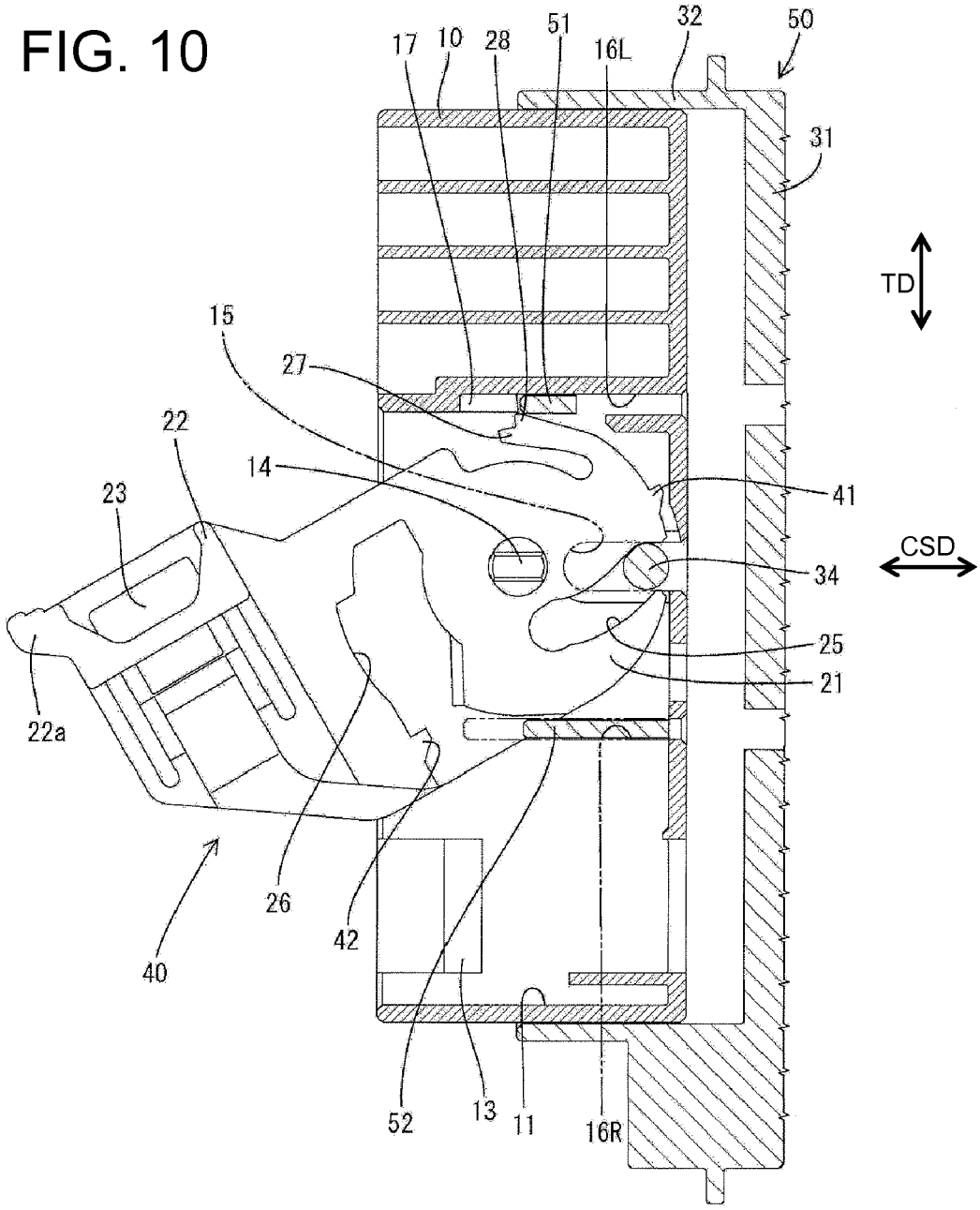
FIG. 10 is a horizontal section showing an intermediate state of a connecting operation of the two housings.

The female housing 10 then is fit into the receptacle 32. Thus, the guide rib 35 of the male housing 30 starts to engage the right guide groove 16R of the female housing 10 and substantially simultaneously the preventing portion 36 of the male housing 30 starts to engage the left guide groove 16L of the female housing 10. As the connection of the housings 10, 30 proceeds, the cam follower 34 enters the cam groove 25 through the cutout 15, as shown in FIG. 2. The preventing portion 36 contacts the locking projection 28 at the leading end of the partial locking arm 27 at substantially the same time to deform the partial locking arm 27 resiliently towards the main portion 21. The deformation of the partial locking arm 27 disengages the locking projection 28 from the partial locking piece 17 to permit rotation of the lever 20 toward the connection position CP (counterclockwise in FIG. 1).

The operable portion 22 then is gripped to rotate the lever 20 towards the connection position CP. The cam action caused by the engagement of the cam groove 25 and the cam follower 34 pulls the two housings 10, 30 towards each other as the lever 20 is rotated. The two housings 10, 30 are connected properly when the lever 20 reaches the connection position CP. A returning movement of the lever 20 from the connection position CP towards the initial position IP is prevented by the engagement of the lock arm 23 of the operable portion 22 with the latch 13 of the accommodation space 11, and a rotation towards a side opposite to the initial position IP is prevented by the contact of a projection 22*a* of the operable portion 22 with the opening edge of the accommodation space 11. In this way, the lever 20 is locked at the connection position CP.

In the properly connected state, the receiving portion 29 of the lever 20 contacts the preventing portion 36 from the side of the male housing 30 to prevent a movement of the lever 20 away from the male housing 30. Movement of the lever 20 away from the male housing 30 also is prevented by the engagement of the cam groove 25 and the cam follower 34. The engaged position of the receiving portion 29 and the preventing portion 36 and the engaged position of the cam groove 25 and the cam follower 34 are separated from each other in the transverse direction at a substantially right angle to the connecting and separating directions CSD of the two housings 10, 30 to prevent the two housings 10, 30 from being inclined about the cam follower 34.

The guide rib 35 and the guide groove 16R extend forward and backward substantially parallel to the connecting and separating directions CSD of the two housings 10, 30 and are engaged to prevent inclination of the two housings 10, 30.

The partial locking means defined by the partial locking arm 27 and the partial locking piece 17 holds the lever 20 at the initial position IP so that the cam follower 34 can easily enter into the cam groove 25 to start the connection of the two housings 10, 30.

The preventing portion 36 is at a transverse position for contacting the locking projection 28 of the partial locking arm 27 when the cam follower 34 enters the cam groove 25 at the start of the connecting operation. Accordingly, the preventing portion 36 is disengaged from the locking projection 28 and the lever 20 is freed from the locked state at the initial position IP when the connecting operation is started. Therefore, the lever 20 can be operated immediately after the cam follower 34 enters the cam groove 25 to provide good operational efficiency.

A second embodiment of the invention is described with reference to FIGS. 9 to 12. A lever-type connector B of the second embodiment differs from the first embodiment with respect to means for preventing two housings 10, 50 in a properly connected state from being inclined. Other construction is similar to or the same as the first embodiment. The similar or identical parts are identified by the same reference numerals, but are not described again.

A main portion 21 of a lever 40 in a female housing 10 is formed with a first receiving portion 41 having the same shape as the receiving portion 29 of the first embodiment and a second receiving portion 42 projecting from an inner surface of a recess 26. The first and second receiving portions 41, 42 are at opposite sides of a support shaft 14 in a transverse direction substantially normal to the connecting and separating directions CSD regardless of at which position the lever 40 is located in a rotatable range from an initial position IP to a connection position CP.

A first preventing portion 51 having substantially the same shape as the preventing portion 36 of the first embodiment is formed on the upper wall of a receptacle 32 of the male housing 50. A second preventing portion 52 also is formed on the upper wall of the receptacle 32. The second preventing portion 52 is at substantially the same position as the guide rib 35 of the first embodiment in the transverse direction, but is shorter than the guide rib 35. The second preventing portion 52 is formed in an area extending from the front end of the receptacle 32 and terminates before a terminal holding wall 31 with respect to forward and backward directions. No projection from the upper wall exists behind the second preventing portion 52. The front ends of the first and second preventing portions 51 and 52 are at substantially the same position in forward and backward directions. However, the rear end of the second preventing portion 52 is farther rearward than the rear end of the first preventing portion 51. In other words, the second preventing portion 52 is longer than the first preventing portion 51 in forward and backward directions.

Figure 11:
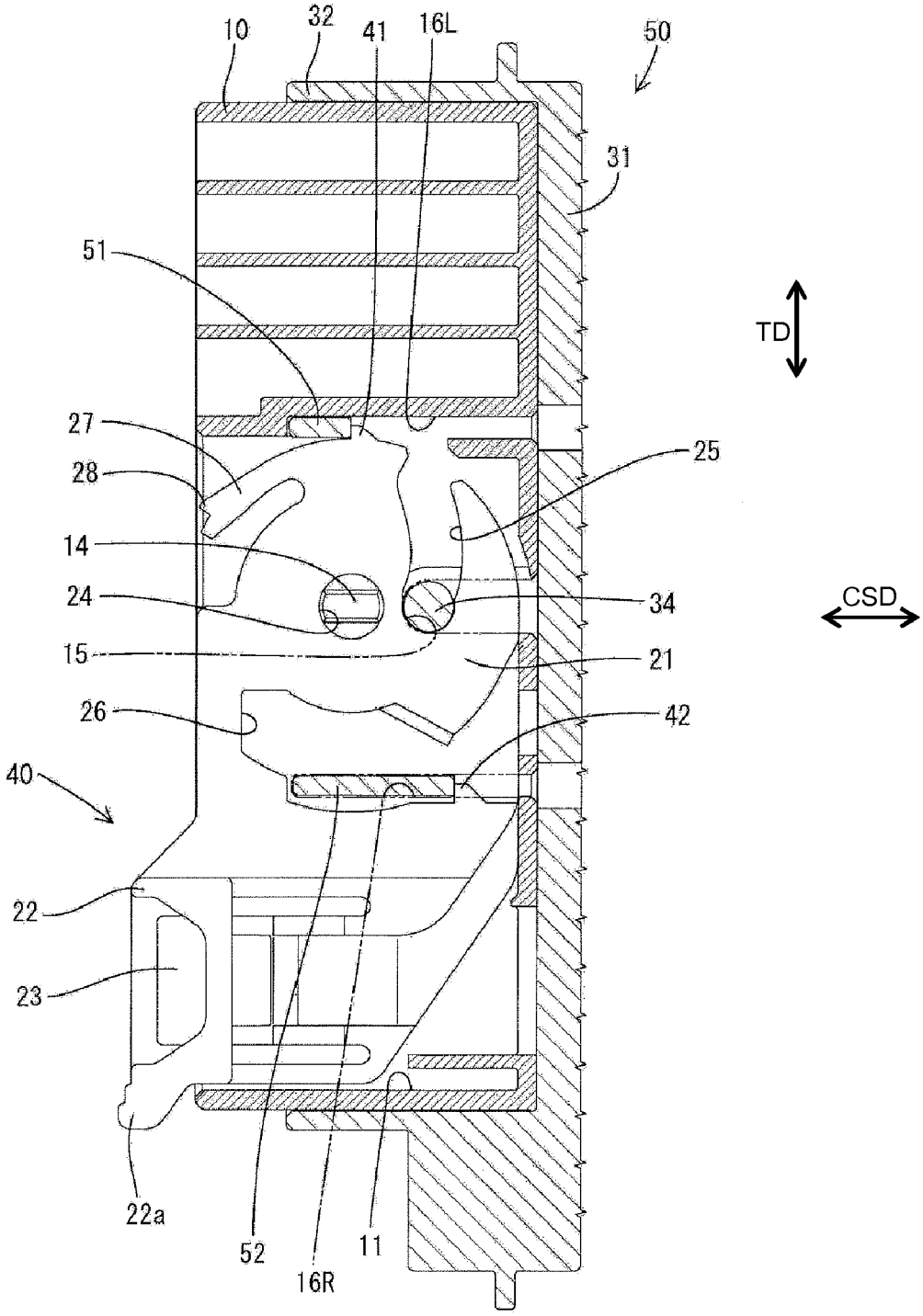
FIG. 11 is a horizontal section showing a connected state of the housings.
Figure 12:
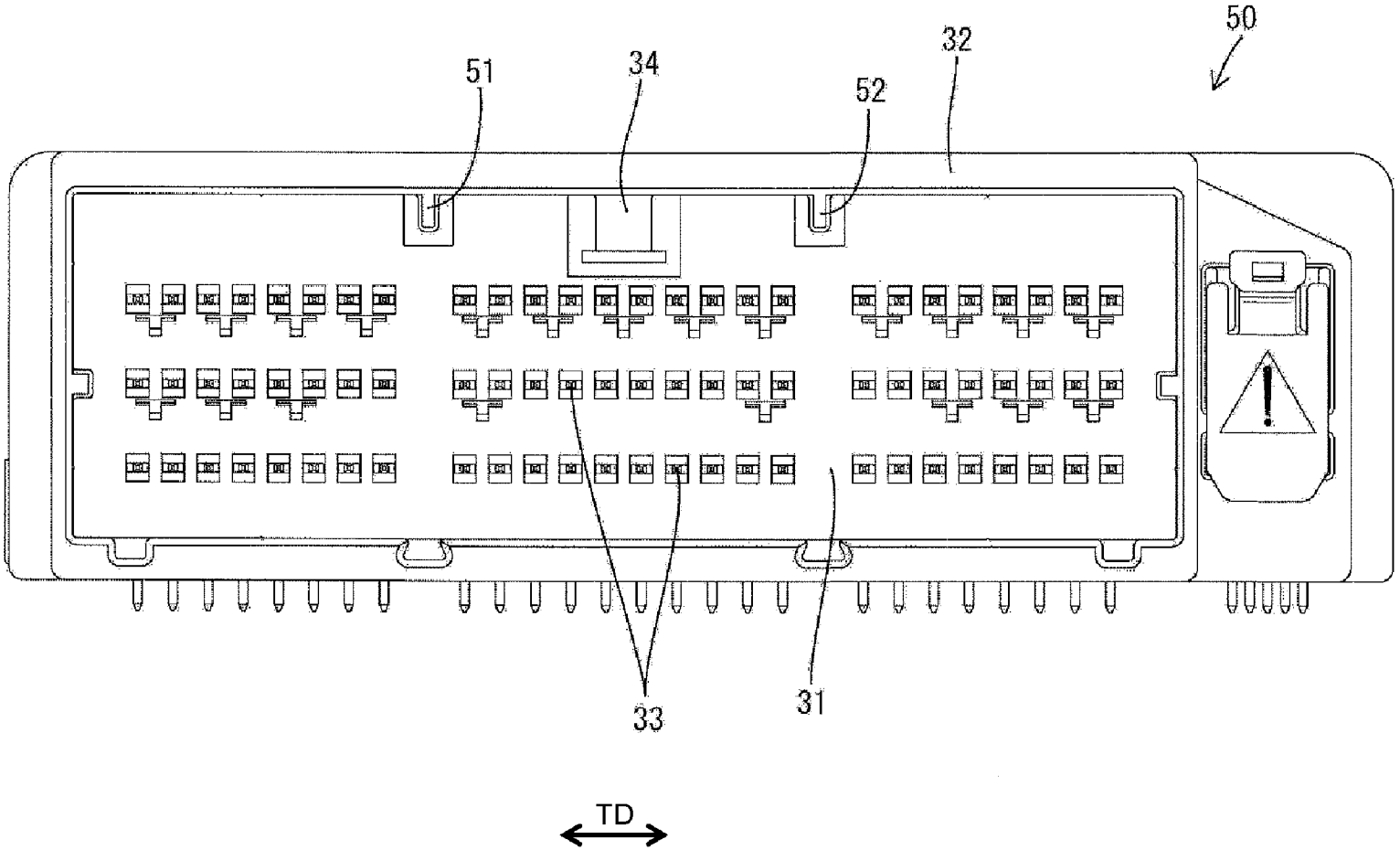
FIG. 12 is a front view of the male housing.

The first receiving portion 41 of the lever 40 contacts the first preventing portion 51 of the male housing 50 from the side of the male housing 50, as shown in FIG. 11, when the two housings 10, 50 are connected properly by operating the lever 40. Thus, a movement of the lever 40 in a direction away from the male housing 50 is prevented. Further, the second receiving portion 42 of the lever 40 contacts the second preventing portion 52 of the male housing 50 from the side of the male housing 50 to prevent the movement of the lever 40 in a direction away from the male housing 50. The movement of the lever 40 away from the male housing 50 preferably also is prevented by the engagement of the cam groove 25 and the cam follower 34. Here, the engaged position of the first receiving portion 41 and the first preventing portion 51 and the engaged position of the second receiving portion 42 and the second preventing portion 52 are located at opposite sides of the cam follower 34 in the transverse direction. Thus, the lever 40 is prevented from moving away from the male housing 50 at three positions, i.e. at the first preventing portion 51, the second preventing portion 52 and the cam follower 34 and these three positions are spaced apart in the transverse direction. Therefore, inclinations of the two housings 10, 50 about the cam follower 34 can be prevented more reliably.

The invention is not limited to the above described and illustrated embodiment. For example, the following embodiments are also embraced by the technical scope of the present invention as defined by the claims.

The lever may be supported on the male housing.

The lever is not limited to the single-plate form and may be such that two arms are connected by an operable portion.

The lever as the preferred movable member may not only be rotatably supported on the housing, but also slidably or displaceably supported so as to make substantially straight movements.

The preventing portion may not be provided with a function of freeing the lever from the partly locked state at the initial position.

What is claimed is:

1. A connector of the movable member type, comprising:

a first housing and a second housing connectable with and separable from each other;

a movable member supported on the first housing and being formed with at least one cam groove;

at least one cam follower provided in the second housing and being engageable with the cam groove of the movable member, the first and second housings being connectable and separable by a cam action caused by engagement of the cam groove and cam follower as the movable member is moved; and at least one preventing portion on the second housing at a position spaced from the cam follower in a direction at an angle to connecting and separating directions of the housings, the preventing portion being engageable with the movable member for locking when the housings are connected and for preventing the movable member from separating from the second housing.

2. The connector of claim 1, wherein two preventing portions are provided at substantially opposite sides of the cam follower in a direction at an angle to the connecting and separating directions of the housings.

3. The connector of claim 1, wherein at least one latch is provided for locking the movable member at a connection position where the housings are connected properly to prevent a returning movement of the movable member towards the initial position.

4. The connector of claim 1, further comprising guide means for guiding relative movement of the housings with respect to each other.

5. The connector of claim 1, wherein the first housing and the movable member include at least one partial locking means for holding the movable member in a partly locked state at an initial position where an entrance to the cam groove is aligned to receive the cam follower.

6. The connector of claim 5, wherein the preventing portion is at a position to contact the partial locking means when the cam follower enters the cam groove to start a connecting operation of the housings.

7. The connector of claim 6, wherein the preventing portion is configured to deflect the partial locking means sufficiently to free the movable member from the partly locked state at the initial position.

8. The connector of claim 7, wherein the partial locking means comprises a substantially cantilever-shaped partial locking arm.

9. A lever-type connector, comprising:

a first housing;

a lever supported on the first housing and being formed with at least one cam groove;

a second housing connectable with the first housing;

at least one cam follower provided in the second housing and being engageable with the cam groove of the lever, the first and second housings being connectable and separable by a cam action caused by engagement of the cam groove and cam follower as the lever is moved; and at least one preventing portion on the second housing at a position spaced from the cam follower in a direction substantially normal to connecting and separating directions of the housings, the preventing portion being engageable with the lever for locking when the housings are connected and for preventing the lever from separating from the second housing.

10. The connector of claim 9, wherein the first housing has a locking piece and the lever has a resiliently deflectable lock arm for engaging the locking piece and holding the lever in a partly locked state at an initial position where an entrance to the cam groove is aligned to receive the cam follower, and the preventing portion being disposed to deflect the lock arm away from the locking piece when the cam follower enters the cam groove to enable the lever to rotate to start a connecting operation of the housings.

11. The connector of claim 10, wherein two preventing portions are provided at substantially opposite sides of the cam follower in the direction substantially normal to the connecting and separating directions of the housings.

* * * * *